US005560128A

United States Patent [19]

Marega et al.

[11] Patent Number: 5,560,128

[45] Date of Patent: Oct. 1, 1996

[54] FASTENING DEVICE FOR SPORTING FOOTWEAR, IN PARTICULAR FOR SKI-BOOT

[75] Inventors: Antonello Marega; Mario Sartor, both of Volpago, Italy

[73] Assignee: Tecnica Spa, Treviso, Italy

[21] Appl. No.: 353,332

[22] Filed: Dec. 5, 1994

[30] Foreign Application Priority Data

Dec. 7, 1993 [IT] Italy ..... TV930056 U

[51] Int. Cl.[6] ..... A43B 5/04

[52] U.S. Cl. ..... 36/118.7; 36/118.2

[58] Field of Search ..... 36/117, 120, 121, 36/50.1, 50.5

[56] References Cited

U.S. PATENT DOCUMENTS

| | | | |
|---|---|---|---|
| 4,519,150 | 5/1985 | Arieh et al. | 36/121 |
| 4,839,973 | 6/1989 | Dodge | 36/121 |

FOREIGN PATENT DOCUMENTS

| | | | |
|---|---|---|---|
| 0085026 | 8/1983 | European Pat. Off. . | |
| 0229405 | 7/1987 | European Pat. Off. . | |
| 0248149 | 12/1987 | European Pat. Off. . | |
| 248149 | 12/1987 | European Pat. Off. | 36/117 |
| 325604 | 6/1990 | European Pat. Off. | 36/117 |
| 0521283 | 1/1993 | European Pat. Off. . | |
| 2498432 | 7/1982 | France | 36/121 |
| 2057094 | 5/1972 | Germany | 36/117 |
| 3821053 | 1/1989 | Germany | 36/117 |
| 9312683 | 7/1993 | WIPO . | |

*Primary Examiner*—James R. Brittain

*Attorney, Agent, or Firm*—Griffin, Butler, Whisenhunt & Kurtossy

[57] ABSTRACT

A fastening device (22) for sporting footwear, in particular for ski-boots, is interposed between shell (12) and boot leg (18) of the ski-boot and comprises at least a first and a second member (24,26) hinged between each other at one of their ends; the opposite ends of the members are hinged to the shell (12) and boot leg (18) respectively and one of the members (24,26) is provided with an operating arm (40). The first member (24) consists of at least two structural portions (34,36) connected between each other at one of their ends so as to be movable between each other making the first member extensible.

17 Claims, 4 Drawing Sheets

FASTENING DEVICE FOR SPORTING FOOTWEAR, IN PARTICULAR FOR SKI-BOOT

The present invention relates to a fastening device for sporting footwear which comprise reclining portions as for example in moto-cross shoes or ski-boots for the "snow-board" or in mountaineering skiing and, in particular, in rear tightening of the boot leg for the ski-boots.

BACKGROUND OF THE INVENTION

With reference to the latter case, it is known that the ski-boots comprise a rigid shell to which a boot leg is hinged to wrap the lower portion of the skier's leg and to allow variations in the bending of the leg with respect to the foot and the ski. Finally, in order to make more comfortable the fit of the ski-boot, an inner shoe is housed inside the shell and boot leg, e.g. a shoe made of soft material. The fastening device includes at least a first and a second member hinged to each other at one of their ends, with the opposite ends of said members being hinged to the shell and boot leg respectively and one of said members being provided with an operating arm.

With reference to the way by which the foot is placed into the ski-boot, there are substantially two kinds of ski-boots. A first type, the so-called front-entry ski-boot, usually has two flaps on the front portion of the ski-boot defining an opening which the foot is put into. The second type, known as rear-entry ski-boot, consists of a shell, a front tongue and a boot leg. It clearly appears that the rear-entry ski-boots allow a more easy entry of the foot into the ski-boot. Furthermore, these ski-boots have a good seal against water and snow.

However, these ski-boots have some drawbacks due to the fact that, in order to allow the entry of the foot, the distance between the ski-boot portion corresponding to the instep and the ski-boot portion wherein the heel is housed, must be increased.

Consequently, the thickness of the shoe portion corresponding to the instep must be increased which results in little effective contact between the foot and the ski-boot.

Another problem is the lack of boot leg inclination adjustment with respect to the shell.

Therefore, central-entry ski-boots have been conceived and made which are similar to the rear-entry ski-boots. These ski-boots, however, are provided with devices which allow the backward inclination of the boot leg with respect to the shell in order to facilitate the entry of the foot thus achieving the usual advantages of the rear-entry ski-boots. Such a kind of ski-boots has another advantage which consists in facilitating walking when the boot leg is inclinated backwards. An embodiment is depicted in European Patent Application No. 0229405, the FIGS. 9 to 12 of which depict a fastening device comprising two cranks 29, 31 hinged between each other by a pin 32 and, respectively, hinged to the shell 1 and to the boot leg 2 by means of respective pins 30 and 35. FIG. 9 illustrates the device in the fastened position wherein the boot leg is inclined forwards. Starting from this position, a crank hinged to the shell is activated so as to move the crank away from the boot leg, and when the device is released the pins 30 and 35 are more near each other and, consequently, the boot leg inclines backwards. In order to take the boot leg to the initial position and to fasten the device, it is sufficient to pull the same crank up to the previous position. However, the above described devices have various drawbacks owing to the fact that during walking activity, when the boot leg is backwardly inclined, as indicated in FIGS. 10 and 11, the device projects from the boot leg. In fact, when considering that during the sporting activity the skier walks in an awkward manner owing to the heavy clothes and sporting equipment such as the skis, a device projecting from the rear part of the ski-boot may hinder the already difficult walk. Furthermore, the device might strike obstacles thus undergoing damages or even hit surrounding people thus causing possible accidents.

SUMMARY OF THE INVENTION

The aim of the present invention consists in making a fastening device for sporting footwear which in the case of the ski-boots allows a backward rotation of the boot leg thus obtaining the two-fold function of facilitating the entry of the foot into the ski-boot and allowing the leg to take an optimum position with respect to the shell in order to facilitate walking.

Another important aim consists in making the device in such a way that it does not project outwards with respect to the boot leg, both in the forward inclined position of the boot leg utilized for skiing and in the backward inclined position utilized for putting on the ski-boot or for walking.

These aims are achieved by a fastening device interposed between said shell and boot leg and characterized in that a first member consists of, at least, two structural portions connected to each other at one of their ends so as to be movable and making the first member extensible.

In a preferred structural embodiment of the device according to the present invention, a second member is a crank whereas the first member consists of a telescopically extendible crank. Furthermore, in a particular embodiment, the boot leg has a seat suitable for housing the device both in a fastened operative position wherein the boot leg is inclined forwardly and in a released position wherein the boot leg is rotated backwardly thus eliminating the drawbacks explained with reference to the mentioned prior art.

Furthermore, the device allows the skier to move the boot leg to the position for skiing.

BRIEF DESCRIPTION OF THE DRAWINGS

The invention will be depicted with reference to the enclosed drawings which illustrate an embodiment given as a non-limiting example. In the drawings.

DESCRIPTION OF PREFERRED EMBODIMENTS

Figure 5:
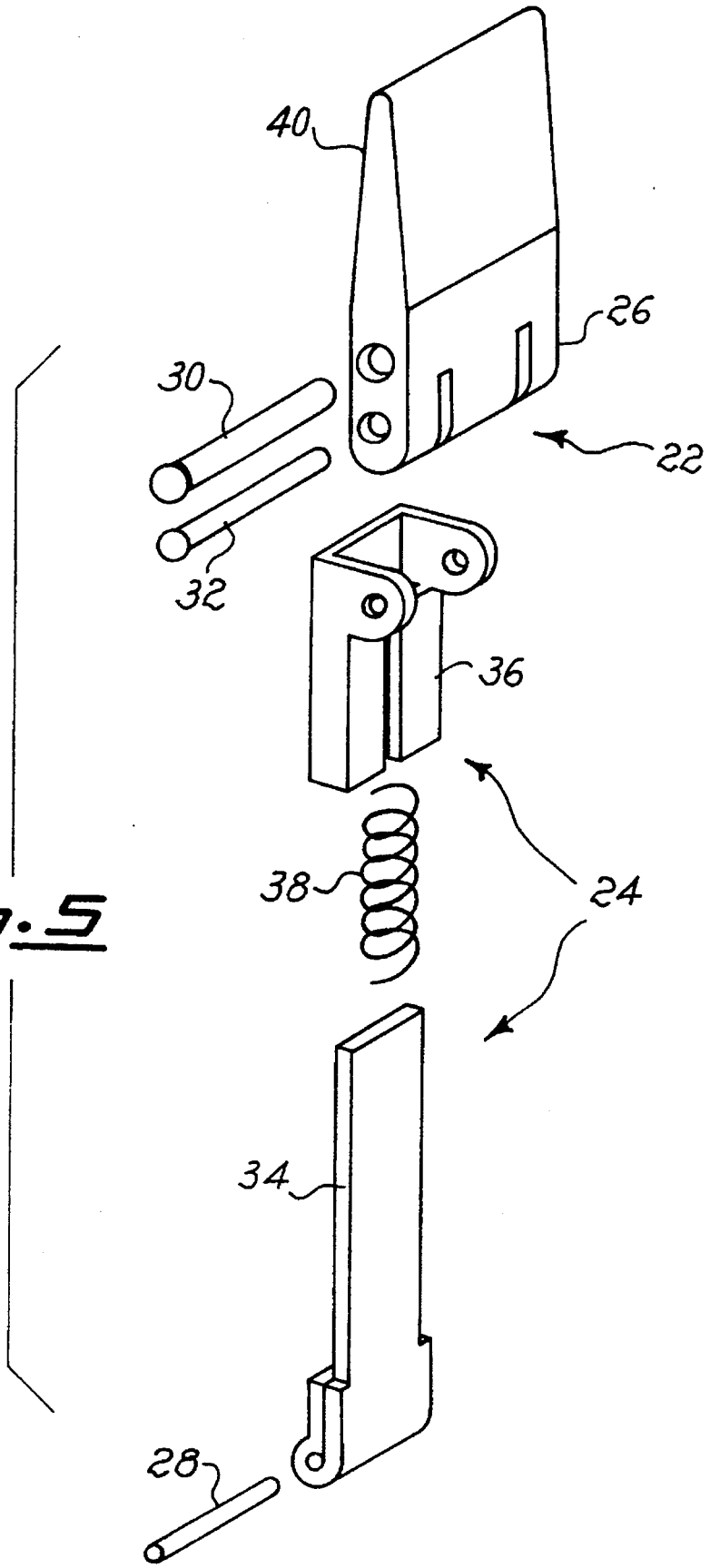
FIG. 5 is a perspective exploded view of the fastening device.

In the figures, a ski-boot is indicated with reference 10, comprising a rigid shell 12 hinged to a boot leg 18 by pins 20 allowing a relative rotation between the boot leg and the shell on a transverse axis. A fastening device 22 is interposed between said shell 12 and boot leg 18 on their rear part to allow a backward movement of the boot leg as will be further explained below. The fastening device 22 comprises a first and a second crank indicated with reference 24 and reference 26 and, respectively, hinged to the shell 12 and boot leg 18 by respective pins 28 and 30 and hinged between each other by a pin 32. The axes of the pins 28, 30 and 32 are perpendicular to the center longitudinal plane of the ski-boot 10 whereby the device movement occurs substantially in this plane. In particular, the first crank 24 comprises two structural portions 34 and 36: the first one is hinged to the boot leg 18 by the pin 28, whereas the second one is hinged to the second crank 26 by the pin 32. The second portion 36 is tubular shaped and inside it the first portion 34 slides so as to form a telescopic structure, as illustrated in FIG. 5. A helicoidal spring 38 is housed inside the second portion 36 and interposed between the latter and the first portion 34. The spring functions to reduce oscillations which may occur during the operating of the fastening device 22. The operation of the crank 26 is facilitated by an arm 40 extending on the opposite side of the crank with respect to the pin 30.

Figure 1:
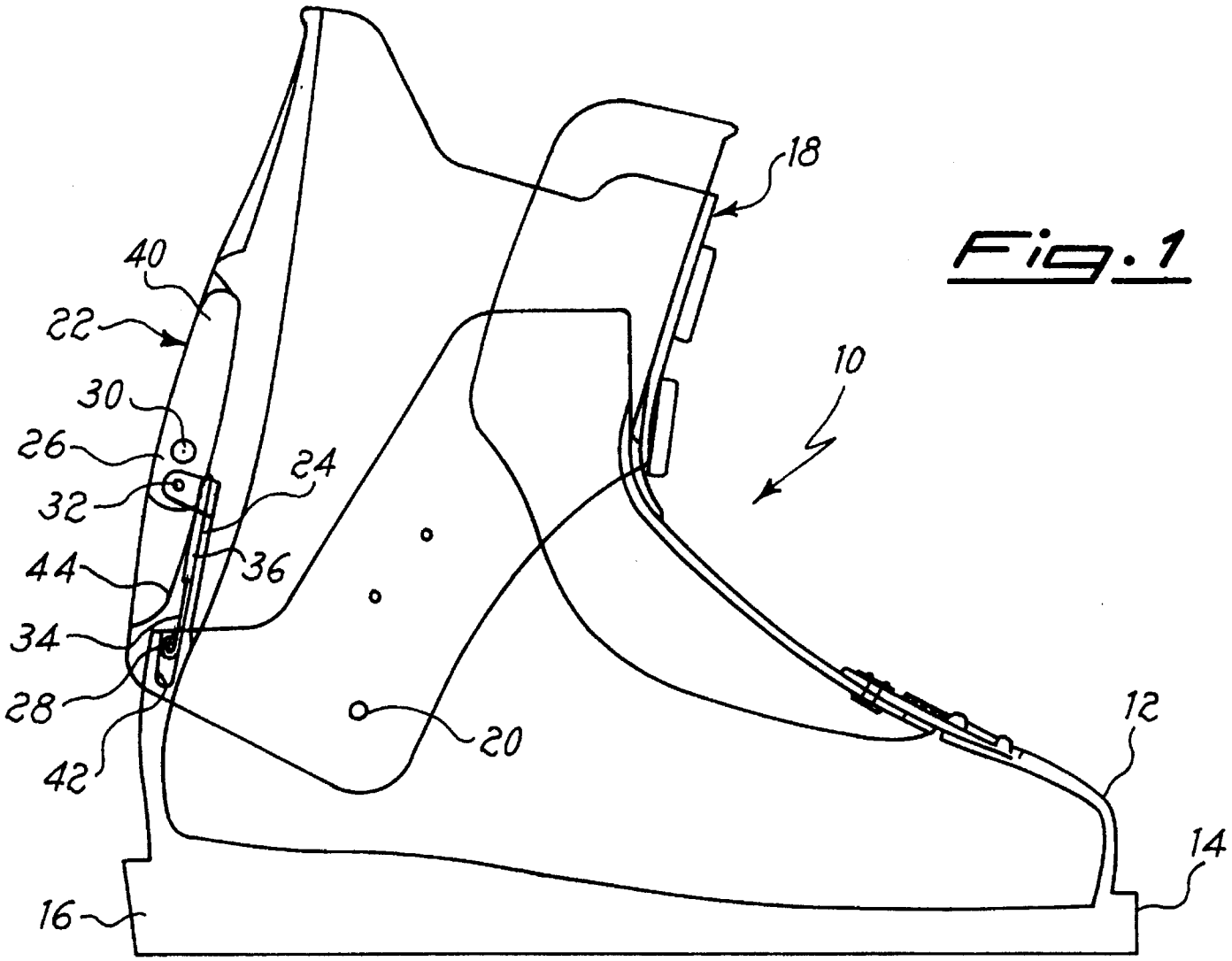
FIG. 1 is a schematic side view, partially sectioned, of a ski-boot according to the invention wherein the fastening device is depicted in the fastened position.

The pin 28 is adjustable along a slit 42 made in the shell 12 allowing the inclination of the boot leg 18 to vary with respect to the shell, both when the device is fastened and the boot leg is positioned forwardly and when the device is released and the boot leg is positioned backwardly. Both in the fastened position represented in FIGS. 1 and 2 and in the released position represented in FIG. 4, the figures illustrate the forward and backward positions of the boot leg respectively, and the fastening device 22 is entirely housed inside a seat 44 made in the boot leg 18.

Figure 4:
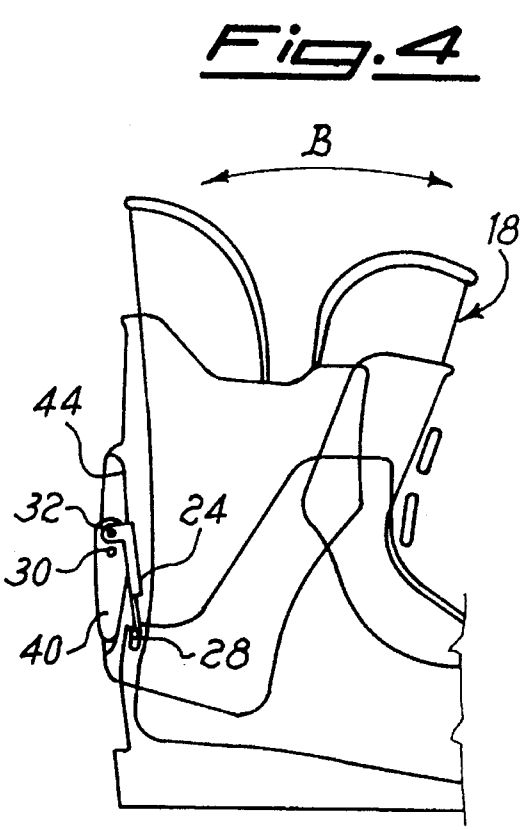
FIGS. 2, 3 and 4 are side views of the same ski-boot, partially sectioned, wherein the device is depicted in a fastened situation for sporting activity (FIG. 2), in a released or walking position (FIG. 3) and as FIG. 4 shows, the successive positions of the fastening lever.
Figure 3:
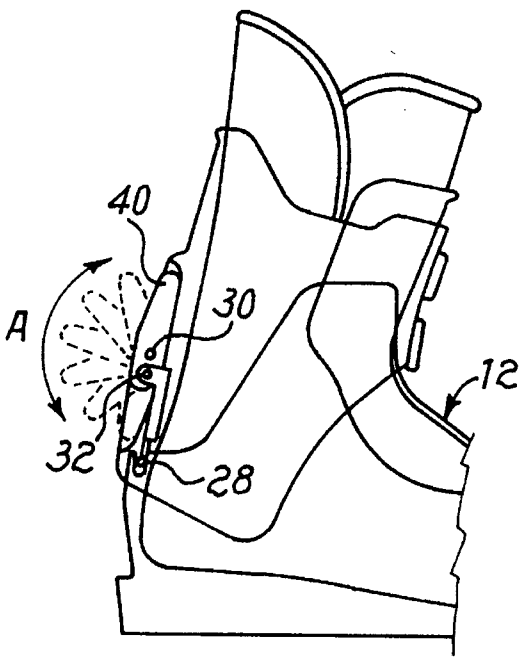
Figure 2:
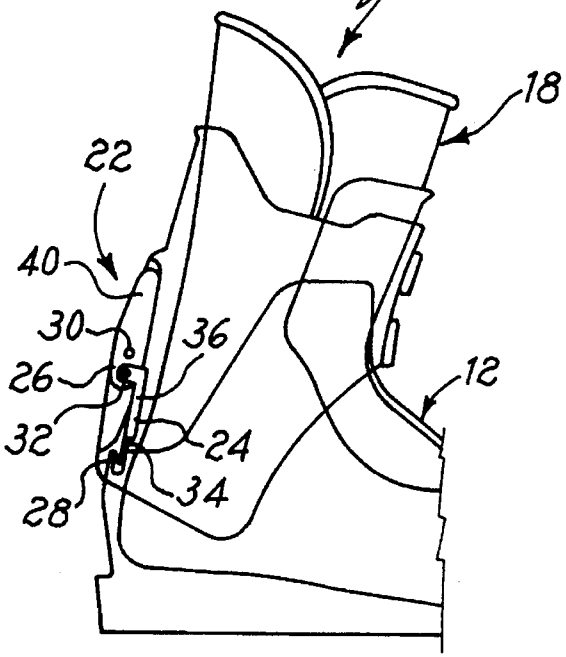

In order to better understand the operating of the fastening device, it is important to point out that, starting from the boot leg position illustrated in FIG. 2, e.g. a position which occurs during skiing activity, a backward rotation of the boot leg 18 on the axis of the pin 20 causes the pins 28 and 30 to approach each other. More properly, FIG. 2 depicts the situation wherein the pin 32 which joins the two cranks 24 and 26 is interposed between the two pins 28 and 30. In such a position, the first portion 34 of the crank 24 is entirely inside the second portion 36 whereas the operating arm 40 and thus the second crank 26 are fastened. Since the second crank 26 is fastened and the first crank 24 is unable to shorten, the two pins 28 and 30 cannot approach each other and therefore any backward rotation of the boot leg 18 is prevented. By rotating the second crank 26, at about 180 degrees, by way of the operating arm 40, as indicated by arrow A in FIG. 3, and fastening crank 26 in such a position, the pin 32 joining the two cranks 24 and 26 reaches the opposite position of the pin 28 with respect to the pin 30, as depicted in FIG. 4. In such a position, the operating arm 40 and the second crank 26 are fastened whereas the first crank 24 is lengthened. Consequently, the boot leg 18 may be rotated backwards, as indicated by arrow B in FIG. 4, up to reaching the position depicted in the same figure wherein the first portion 34 is entirely inside the second portion 36 and, thus, preventing the boot leg to further rotate backwards. Such a limit position depends on the maximum variation in the length of the first crank 24.

In order to take the boot leg 18 to the previous position and to fasten the device, it is sufficient to rotate the operating arm 40; consequently, the second crank 26 rotates on its pin 30 and the pin 32 joining the two cranks moves to an intermediate position between the two pins 28 and 30 causing a reduction of the distance between the pins 28 and 32 and the length of the first crank 24. Since the first crank 24 is entirely retracted and it cannot be shortened further, the two pins 28 and 30 must necessarily move away from each other whereby the boot leg 18 is compelled to move forwards and, when the operating arm 40 reaches the initial position, the boot leg is inclined forwards (see FIG. 2). Finally, by fastening the operating arm 40, the boot leg 18 is prevented from rotating backwards.

An alternative for taking the boot leg 18 to the initial position and to fasten the device, consists in inclining the boot leg 18 forwardly, whereas, at the same time, the first crank 24 lengthens thus reaching the position wherein it is entirely lengthened and the boot leg is inclined forwardly. Later, it is sufficient to rotate, at 180 degrees approximately, the second crank 26 by the operating arm 40 thus reaching the position depicted in FIG. 2 wherein the first crank 24 is entirely retracted preventing the boot leg 18 from inclining backwards.

It is self-evident that modifications and conceptual changes and functional equivalents are possible and are intended to be within the scope of the present invention. For example, a modified embodiment of the fastening device according to the present invention consists of a device similar to the previous one wherein the first crank, hinged to the shell, is of a predetermined length and provided with an operating arm on the opposite side of the crank with respect to the point at which it is hinged to the shell and the second crank, hinged to the boot leg, is telescopically extendible. For clearness purposes, the same numeral references of the preceding embodiment will be used to indicate similar or analogous members.

In the situation wherein the device is fastened, the operating arm 40 and then the first crank 24 are fastened, the pin 32 joining the two cranks is interposed between the pins 28 and 30 and the second crank 26 is completely retracted. Consequently, any backward inclination of the boot leg 18 is prevented since the distance between the two pins 28 and 30 cannot be reduced. By rotating the operating arm 40, at about 180°, the pin 32 reaches the position located on the opposite side of the pin 30 with respect to the pin 28 and the second crank 26 lengthens. Therefore, the boot leg 18 may be rotated backwards, consequently reducing the length of the second crank, up to reaching the position wherein the crank is entirely retracted. In order to take the boot leg 18 to its original position and to fasten the device 22, it is sufficient, as previously described, to rotate the operating arm 40, at about 180° or alternatively, to move the boot leg forwards and successively rotate the operating arm 40 fastening the device 22.

This invention has several advantages due to the fact that the fastening device is housed inside the seat suitably made in the boot leg, not only when the device is fastened and the boot leg in such a position to allow skiing activity, but also when the same is released and the boot leg is in the upright position to facilitate ambulation. For example, it is easy to note that the device, which does not project from the boot leg during the walking activity when it is in the upright position, provides a reduced possibility that the skier may stumble while he walks. Moreover, possible damages, which the device might undergo owing to collisions, are eliminated.

Figure 6:
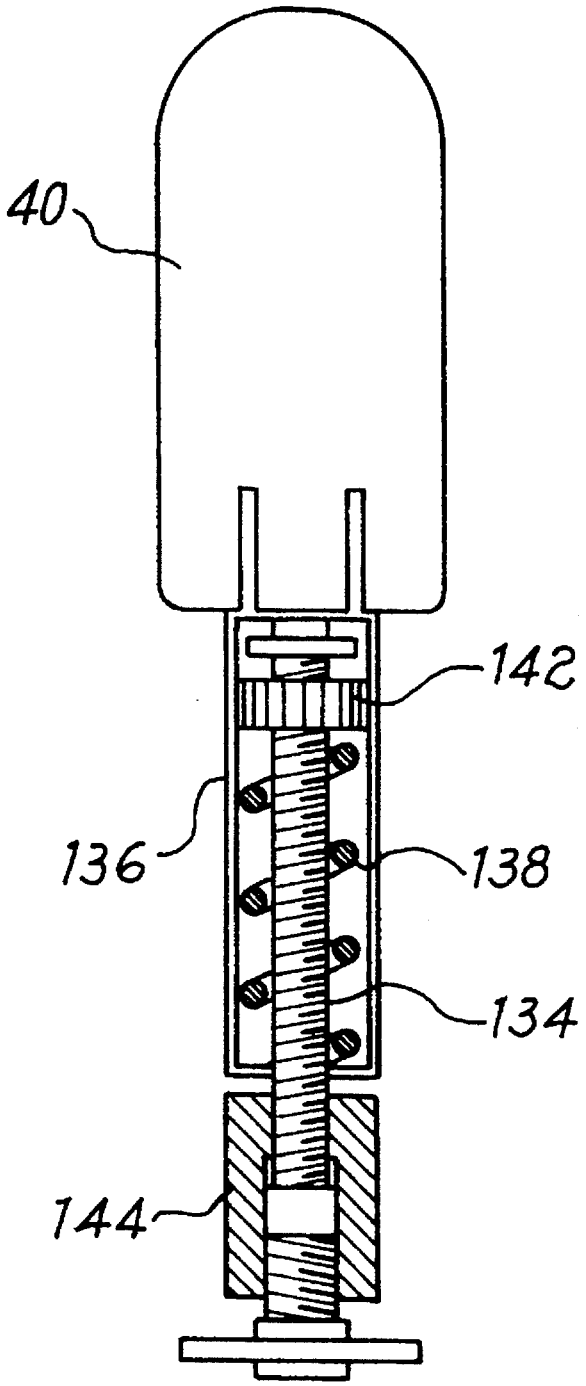
FIG. 6 is a schematic view of a modified embodiment of the fastening device.

A further improvement of this invention may consist of gradually moving the support point of the first crank to the shell to permit a greater forward inclination of the boot leg. The device may be provided with a spring structure, in combination with the latter feature of the device or alone, which, when loaded, may limit the forward flexibility of the ski-boot. This modified embodiment is illustrated in FIG. 6, wherein the references of the previous figures have been used as much as possible. In this case, the numeral 40 indicates again the operating arm, to which a drawer-shaped member 136, corresponding to the tubular structural member 36 of FIG. 5, is attached. The drawer-shaped member 136 houses a pin 134 (equivalent to the structural member 34 of FIG. 5), on the outer surface of which a threaded nut 142 is mounted, and the position of which along the pin 134 may be adjusted from the outside. A compression spring 138 is interposed between the bottom of the drawer-shaped member 136 and the nut 142, which spring has the same cushioning function of the spring 38 of FIG. 5. The lower end of the pin 134 is integral with a knob 144 by means of threads whereby the knob may be moved along the axis of the pin 134. From the above description, it is self-evident that the embodiment of FIG. 6 assures, not only, the fastening and releasing functions of the embodiments illustrated in the preceding figures, but it also achieves the following functions:

a) the adjusting of the maximum inclination of the boot leg by varying the position of the knob 144; and b) the adjusting of the boot leg bending by varying the position of the nut 142.

This invention, as previously stated, may be used in other sporting footwear. For example, the device may be used for the side fastening of "snow-board" ski-boots or for the fastening of the front tongue of mountaineering ski-boots.

I claim:

1. In a fastening device for sporting footwear comprising a rigid shell (12) on which a leg (18) is pivotably mounted and is pivotable from a closed position with respect to the shell to an opened position with respect to the shell, said fastening device (22) being interposed between said shell (12) and leg (18) and including at least a first and a second member (24,26) hinged to each other at ends thereof and opposite ends of said members being hinged to the shell (12) and leg (18) respectively for locking the leg in the closed position or for allowing a pivoting of the leg to the opened position and one of said members (24,26) being provided with an operating arm (40), the improvement comprising the first member (24) having at least two structural portions (34,36) slidably connected to each other so as to make the first member slidably extensible.

2. Fastening device according to claim 1, wherein one of said at least two structural portions (34,36) has at least one groove in which at least a jut of the other structural portion slides.

3. Fastening device according to claim 1, wherein one of said at least two structural portions (34,36) is tubular-shaped and the other structural portion slides in the tubular shape to form a telescopic structure.

4. Fastening device according to claim 3, wherein said tubular shape is drawer-like (136) shaped into which a pin (134) is housed, and a nut (142) for adjusting bending of the leg is adjustable along said pin.

5. Fastening device according to claim 4, wherein said nut (142) is threaded so as to engage an outer thread formed on said pin (134) and the outer surface of the nut is knurled.

6. Fastening device according to claim 4, wherein a compression spring (138) is interposed between said nut and a bottom of the drawer-like shape.

7. Fastening device according to claim 4, wherein a knob (144) is attached to an end of said pin outside said drawer-like shape, and a knob which is movable and adjustable along the axis of said pin is engaged with said pin.

8. Fastening device according to claim 7, wherein said knob has a thread engaged with an outer end of said pin.

9. Fastening device according to claim 1, wherein the device is located at a rear part of the footwear, said first member (24) is hinged to the shell (12), said second member (26) is hinged to the leg (18) and said operating arm (40) is formed on the second member (26).

10. Fastening device according to claim 9, wherein the device has an operative position wherein a hinge point of the two members (24,26) is between hinge points of the members to the shell and leg and wherein the first member (24) is at its shortest slidable position so as to prevent a backward movement of the leg (18).

11. Fastening device according to claim 9, wherein the device has an operative position wherein a hinge point of the two members (24,26) is located on an opposite side of a hinge point where the first member (24) is hinged to the shell (12) with respect to a hinge point of the second member (26) when hinged to the leg (18) and the first member (24) is at its maximum extension so as to allow a backward movement of the leg (18) up to a position the first member (24) is at its shortest position.

12. Fastening device according to claim 9, wherein said first member (24) is hinged to the shell (12) in at least two positions.

13. Fastening device according to claim 12, wherein said first member is hinged to the shell (12) by a pin, the position of which is adjustable along a slit (42) in the shell.

14. Fastening device according to claim 1, wherein said second member is a crank.

15. Fastening device according to claim 1, wherein the device is housed inside a seat (44) in the leg (18).

16. Fastening device according to claim 1, wherein a dampening member (38) is interposed between said two structural portions (34,36).

17. Fastening device according to claim 16, wherein said dampening member (38) consists of a helicoidal spring.

* * * * *